US007183526B2

(12) United States Patent
Yoshino et al.

(10) Patent No.: US 7,183,526 B2
(45) Date of Patent: Feb. 27, 2007

(54) APPARATUS AND METHOD FOR HEATING WORKS UNIFORMLY THROUGH HIGH FREQUENCY INDUCTION COILS

(75) Inventors: Koshiro Yoshino, Shizuoka (JP); Masahiro Yoshino, Shizuoka (JP); Yasuhiro Yoshino, Shizuoka (JP)

(73) Assignee: Kabushiki Kaisya Yoshino Kosakujo, Shizuoka (JP)

( * ) Notice: Subject to any disclaimer, the term of this patent is extended or adjusted under 35 U.S.C. 154(b) by 0 days.

(21) Appl. No.: 11/073,224

(22) Filed: Mar. 7, 2005

(65) Prior Publication Data

US 2005/0230380 A1 Oct. 20, 2005

(30) Foreign Application Priority Data

Mar. 12, 2004 (JP) ..... 2004-070592

(51) Int. Cl.
*H05B 6/10* (2006.01)
*H05B 6/40* (2006.01)

(52) U.S. Cl. ..... 219/635; 219/609; 219/656; 219/662; 219/667; 219/672; 219/676; 118/719; 427/557

(58) Field of Classification Search ..... 219/635, 219/609, 655–656, 661–667, 670–676; 118/719, 118/724; 427/557, 591
See application file for complete search history.

(56) References Cited

U.S. PATENT DOCUMENTS 4,258,241 A * 3/1981 Soworowski ..... 219/656
4,357,512 A * 11/1982 Nishimoto et al. ..... 219/608
5,055,647 A * 10/1991 Heyes et al. ..... 219/645
6,107,613 A 8/2000 Welch et al.
6,498,327 B1 12/2002 Thelander
6,576,878 B2 * 6/2003 Thorpe et al. ..... 219/645
2002/0121512 A1 9/2002 Thorpe et al.
2002/0134311 A1 * 9/2002 Yoshino et al. ..... 118/719
2003/0019868 A1 1/2003 Beer

FOREIGN PATENT DOCUMENTS

EP 0 385 571 A1 9/1990
EP 1 270 089 A1 1/2003
JP A 2002-126584 5/2002
JP A 2003-10737 1/2003

* cited by examiner

*Primary Examiner*—Philip H. Leung
(74) *Attorney, Agent, or Firm*—Oliff & Berridge, PLC

(57) ABSTRACT

A high frequency induction-heating device 3 of the apparatus 1 for heating work includes a pair of opposite work coils accommodated within the coil casings 17 and 19 respectively. The casings 17 and 19 can be displaced in a unit by a motor provided under the device. Thus, the distance between the pair of work coils, and the distance between the work (W) and each work coil can be adjusted. The apparatus includes a plurality of heating devices 3 to which high frequency power sources are provided respectively. The apparatus and method for heating of a work with the apparatus is capable of treating a plurality of works (W) continuously under controlled conditions on work coil shapes and positions depending on the size and/or the shape of the works (W).

10 Claims, 11 Drawing Sheets

(1)Displacing motor: driven (2)Shifting motor: driven

APPARATUS AND METHOD FOR HEATING WORKS UNIFORMLY THROUGH HIGH FREQUENCY INDUCTION COILS

BACKGROUND OF THE INVENTION

The present invention relates to an apparatus and a method for heating relatively larger and/or complex shaped works uniformly without occurring over baking or short of baking.

DESCRIPTION OF THE PRIOR ART

High frequency induction-heating technology have been used only to heat small work one by one or to heat the work of uniform profile such as a pipe. This is because precise control of temperature is difficult in the high frequency induction-heating technology.

However, in the high frequency induction-heating technology, works generate heat in itself. Thus, when the induction-heating technology is used to bake powder-coated works, the coating is heated from the surface of the work so that the coating can be secured more strongly. Degreasing operation can be omitted because oils and the like are evaporated and removed. Further, a dome-shaped drying facility is not required because the works are not heated from the outside.

The applicant of this application have been developed apparatus for heating works, employing the high frequency induction-heating technology as disclosed in the Japanese patent laid-open public disclosure (kokai) Nos.2002-126584 (2002) and 2002-10737(2002).

DISCLOSURE OF THE INVENTION

Although the apparatus for heating works disclosed in the above-mentioned documents could heat a plurality of works uniformly, the work size of uniformly heat-able work is limited. With respect to the larger the work, it is necessary to provide larger work coils and to enhance the output therefrom. However, the size of the work coil is limited physically, i. e. the work coil cannot be enlarged with no limit. In addition, if the heating operation is made by only one output source, the temperature of the work tends to be scattered.

The object of the present invention is to solve the above-mentioned problems through an apparatus and a method for heating a plurality of works of various size or shape continuously.

SUMMARY OF THE INVENTION

These and other objects are achieved by an apparatus for heating a work comprising a plurality of high frequency induction-heating devices, each device including a pair of opposite work coils, a distance adjuster for adjusting the distance between the work and each work coil, and an output adjuster for adjusting high frequency output of the work coils.

Further, these and other objects is also achieved by a method of for heating a work of a first aspect of this invention by means of the heating apparatus according to the above, comprising the steps of: preparing a work to be heated, passing the work continuously through the pair of work coils of the high frequency induction-heating devices.

There is provided a method for heating a work of a second aspect of this invention, in addition to the first aspect, further comprising the steps of: examining with a sample work how a plurality of portions of the work is heated, obtaining, based on the examination, information for uniform heating the work, on distance to be kept between each work coil and the work and/or on output of the work coils to heat the work, and heating the work based on thus obtained information while adjusting the distance and/or the output.

There is provided a method for heating a work of a third aspect of this invention, in addition to the first or second aspect, further comprising the steps of: mounting on the high frequency induction-heating device, a thermometer for measuring the temperature of the work, and adjusting the distance and/or the high frequency output based on temperature information from the thermometer.

The apparatus and method for heating of a work of the present invention is capable of treating a plurality of works (W) continuously under controlled conditions on work coil shapes and positions depending on the size and/or the shape of the works (W).

BRIEF DESCRIPTION OF THE DRAWINGS

Further feature of the present invention will become apparent to those skilled in the art to which the present invention relates from reading the following specification with reference to the accompanying drawings, in which.

DETAILED DESCRIPTION OF THE PRESENT INVENTION

Figure 1:
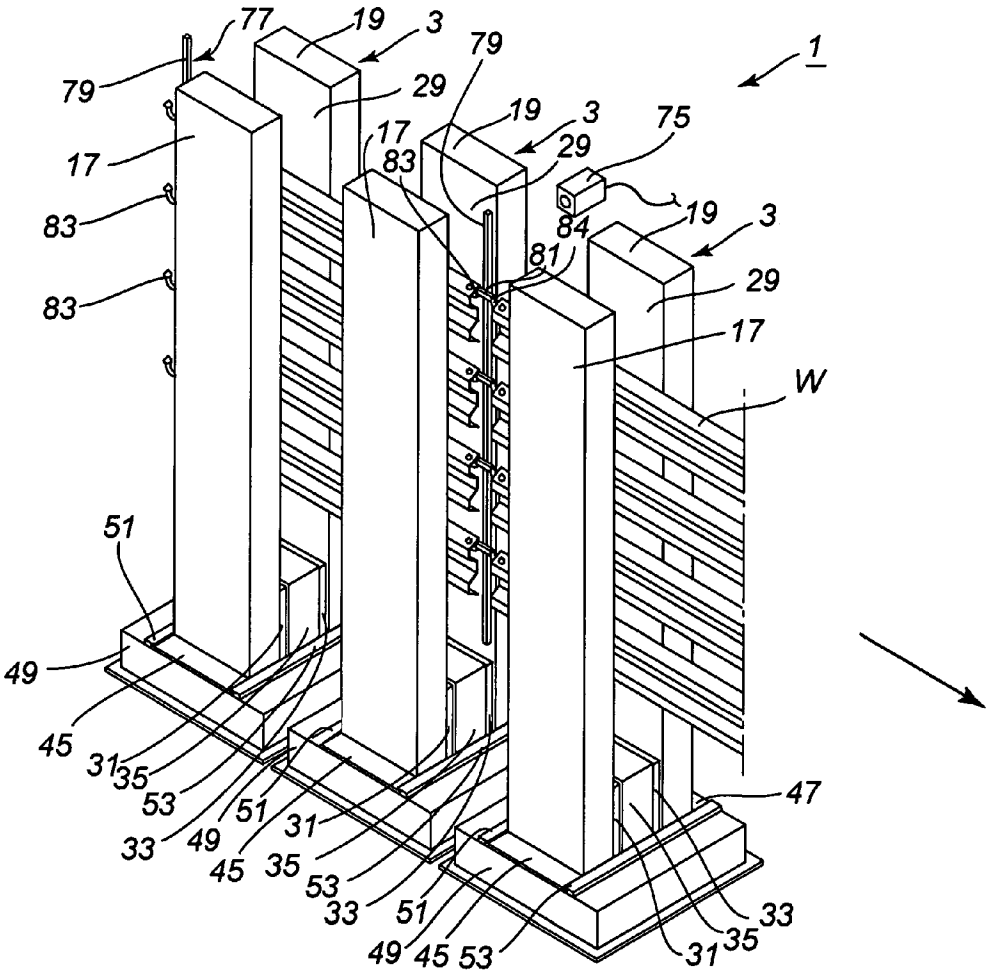
FIG. 1 is a perspective view showing the apparatus for heating a work in accordance with a first embodiment of the invention.

An apparatus 1 for heating a work (W) in accordance with a first embodiment of the invention will now be described with reference to FIGS. 1–12.

The reference numeral 3 designates a high frequency induction-heating device 3 including a pair of opposite work coils 5, 7 positioned opposite.

Figure 2:
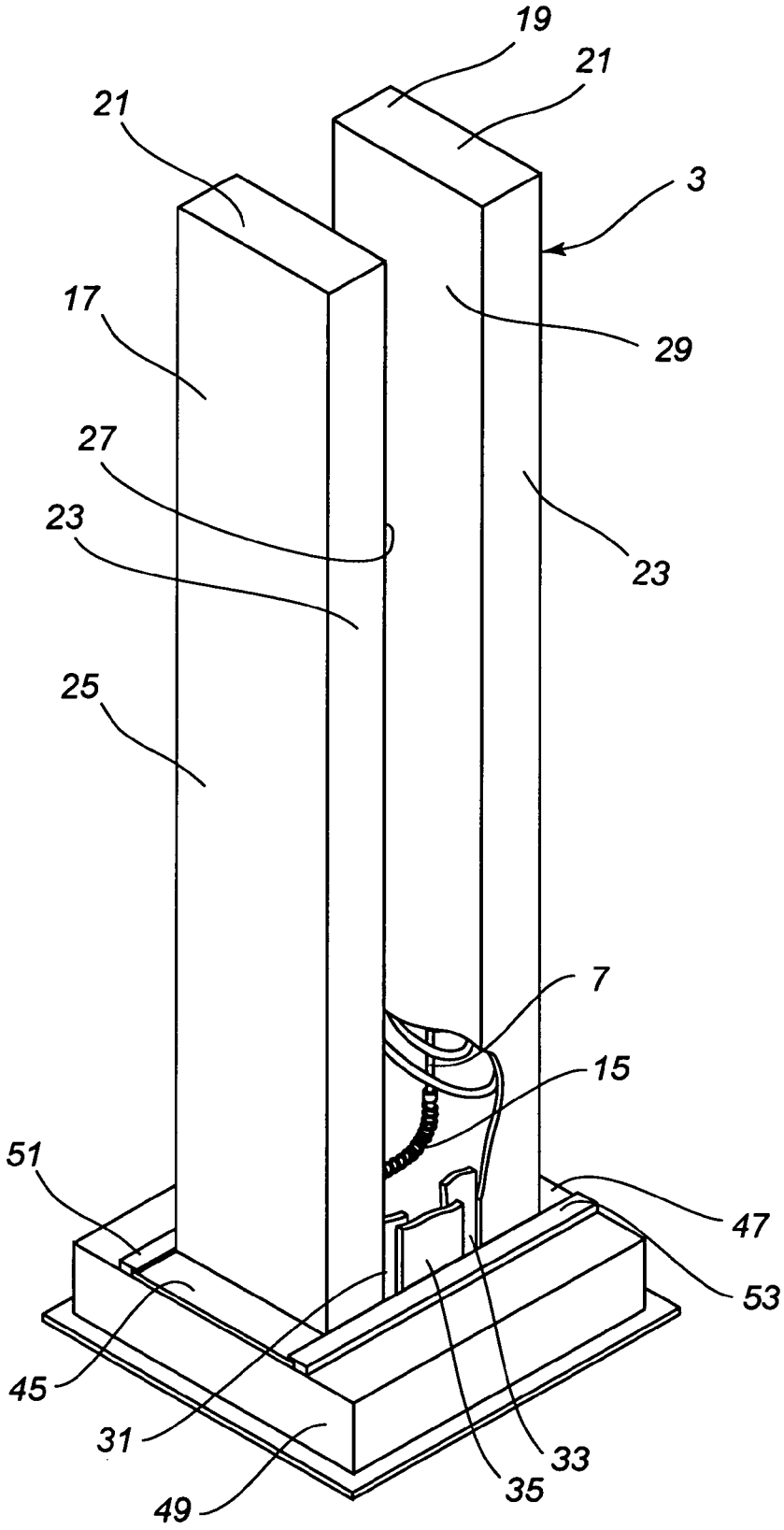
FIG. 2 is a partially broken away perspective view showing the high frequency induction-heating device of the heating apparatus of FIG. 1.
Figure 3:
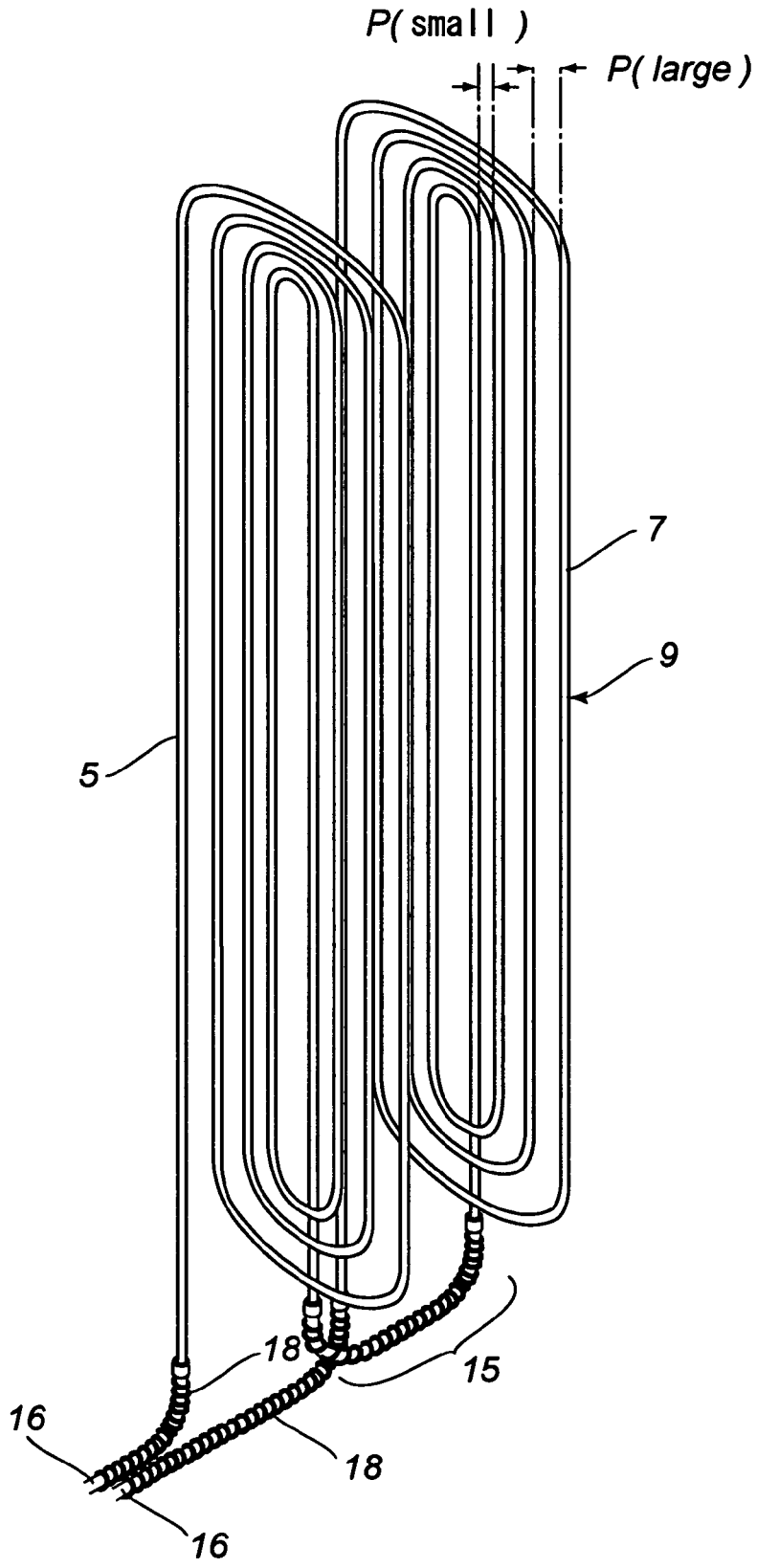
FIG. 3 is a perspective view showing the work coils of the heating apparatus of FIG. 1.

The work coils 5, 7 are formed of a copper tube 9 wound to form a pair of swirl shaped coils as shown in FIGS. 2 and 3. The pitch (P) of each swirl is reduced gradually toward the central portion to eliminate cancellation out of the eddy currents.

The coils 5, 7 are connected with each other through an electrically conductive flexible cooling conduit 15. Remaining end portions of the coils 5,7 are also connected with a pair of conduits 15.

Thus obtained structure in which the coils 5, 7 are connected through one flexible conduit 15 is suitable for use in limited space.

The electrically conductive flexible cooling conduit 15 includes a flexible water tube 16 and flexible copper wires 18 braided or wounded therearound. Thus the work coils 5, 7 serve for passing coolant water as well as electric current therethrough. In addition, the work coils 5,7 can be moved toward or away from each other, since the conduit 15 is made of flexible member.

A pair of vertically extending coil casings 17 and 19 is disposed opposite with each other. The work coils 5, 7 are accommodated within the casings 17 and 19 in their vertically standing position.

The coil casings 17, 19, respectively, include their upper surfaces 21, side surfaces 23, and back surfaces 25 of copper plates for shielding the effect of the high frequency energy. The opposite front surfaces of the casings 17, 19 are covered with a pair of plates (chemit plate) 27, 29 for avoiding the contact of the work coils 5, 7 with the works (W).

The spacing between the casings 17 and 19 at the lower portion thereof is provided with inverted-U shaped partitions 31, 33 and 35 of copper material for shielding the high frequency energy. The left side of the partition 31 is secured to the casing 17, the right side of the partition 33 is secured to the casing 19, and the partition 35 is engaged with the partitions 31 and 33 so as to be displaceable with respect thereto.

The partitions 31, 33 and 35 shield the drive assembly including the motor 59 from the high frequency energy.

The partitions 31 and 33 are provided at their lower portions with plates 37 and 39 through which threaded portion are formed respectively. The plate 37 is secured to the casing 17 at its lower end and to the partition 31 at its side. The plate 39 is secured to the casing 19 at its lower end and to the partition 33 at its side.

The direction of the helical thread provided through the plate 37 is opposite or invert with respect to that of the plate 39.

Openings 41, 43 for passing the electrically conductive flexible cooling conduit 15 therethrough are defined between the partitions 31 and 33 and the plates 37 and 39.

The coil casing 17 and 19 have their bottom portions thereof, slide blocks 45 and 47 respectively. A bed for mounting the device is designated by the reference numeral 49. A pair of guide rails 51 and 53 on which the slide blocks 45 and 47 are slidably engaged are to be mounted on the bed 49.

A motor for displacing the casings is designated generally by the reference numeral 59. The displacing motor 59 is connected to a displacing screw 61 through a belt 60. The screw 61 is threadably connected to the threaded portions of the plates 37 and 39.

Upon driven the motor 59, a device half including the coil casing 17 (including the cover 27), the partition 31, and work coil 5 and the other device half including the coil casing 19 (including the cover 29), the partition 33, and work coil 7 are displaced toward or away from each other, i. e. the distance (D) between the coils 5 and 7 is varied.

A supporting block is designated generally by the reference numeral 65. The supporting block 65 has a downwardly extending portion at the one end thereof. The displacing motor 59 and a bearing 63 of the displacing screw 61 are also secured to the block 65. The downwardly extending portion or the support plate 65 is provided with a thread 67 extending therethrough.

A motor for shifting the center of the device is designated generally by the reference numeral 69. The center shifting motor 69 is secured on the slide block 47. The center shifting motor 69 is provided with a shifting screw 71 threadably engaged with the thread 67 of the support plate 65.

Figure 4:
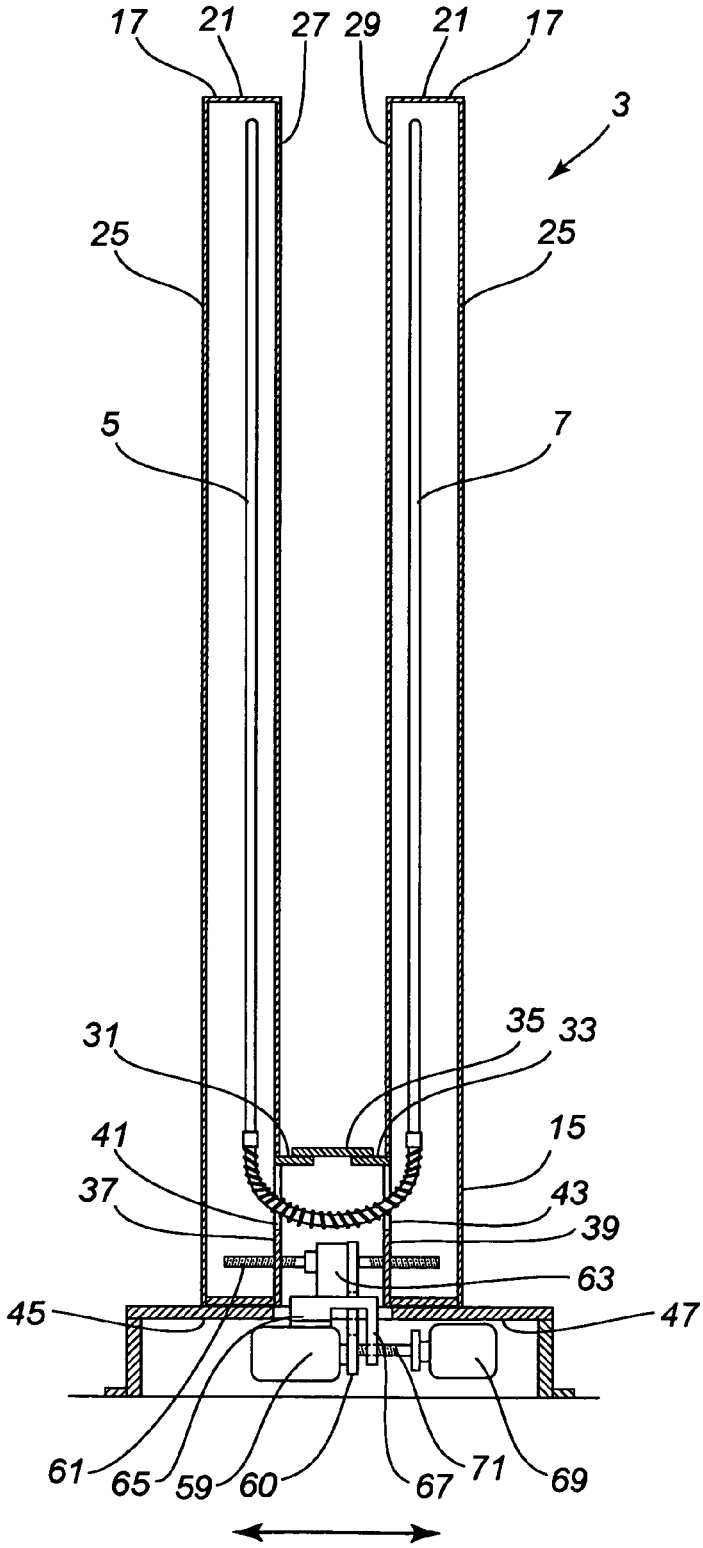
FIG. 4 is a cross sectional view showing the induction-heating device of FIG. 2.
Figure 5:
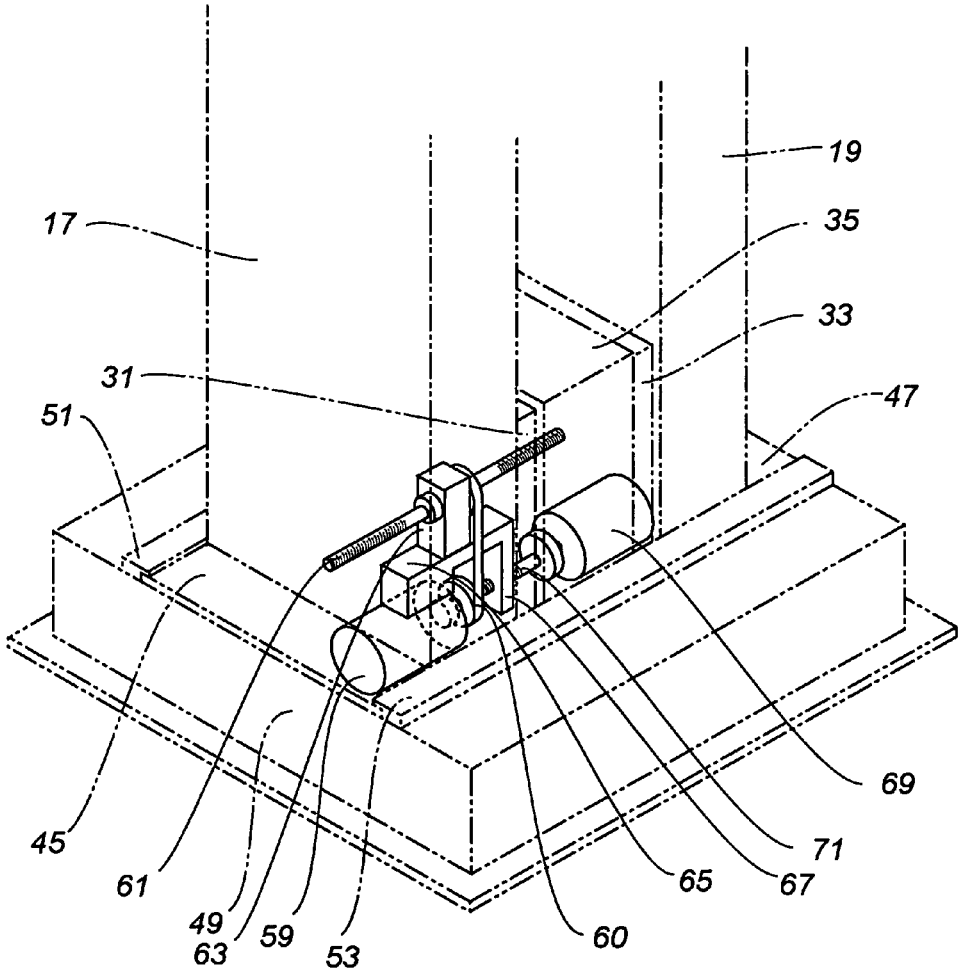
FIG. 5 is a perspective view showing the drive assembly of the induction-heating device of FIG. 2.

Upon driven the center shifting motor 60, the bearing 63, the displacing screw 61, and the displacing motor 59 are moved together with the support plate 65, i. e. the coil casings 17 and 19 will be shifted in the directions designated by the double-headed arrow in FIG. 4 with keeping the distance (D) between the coils 5 and 7.

The distance (D) between the work coils 5 and 7, the distance (d(r)) between the work (W) and the work coil 5, and the distance (d(l)) between the work (W) and the work coil 7 can be varied by driving the motors 59 and 69 independently.

Figure 6:
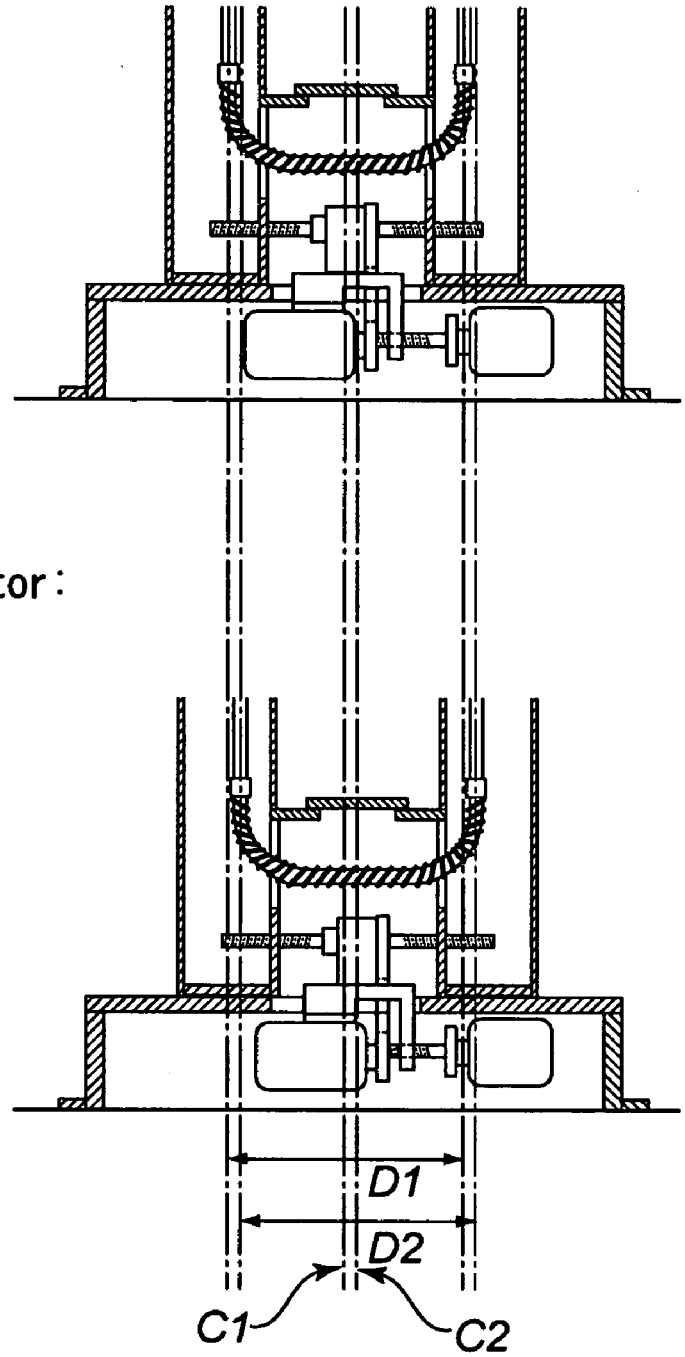
FIG. 6 is a cross sectional view showing the mode of operation of the induction-heating device of FIG. 2.

In FIG. 6 (1), the work coils 5 and 7 are displaced by the motor 59 to increase the distance between coils. In FIG. 6 (2), the motor 69 is then driven to shift the work coils 5 and 7 rightward.

Although the distance (D1) between coils 5 and 7 in FIG. 6 (1) is the same as the distance (D2) between coils in FIG. 6 (2), the center line (C1) in FIG. 6 (1) is shifted rightward to the centerline (C2) in FIG. 6 (2).

A commercial high frequency power source (not shown) is connected to both ends of the copper tube 9 defining the work coils 5, 7 of the high frequency induction-heating device 3. The tube is also connected with a coolant-circulating unit (not shown).

The apparatus 1 for heating works (W) includes three high frequency induction-heating devices 3 of the structure as mentioned above. In order to differentiate these heating devices, each device is referred hereinbelow to as No. 1 coil device, No. 2 coil device, and No. 3 coil device respectively. The passage through which the works (W) are to be transferred is defined by the spacing between the coils 5 and 7 of each coil device.

The non-contact radiation thermometer designated by the reference numeral 75 is positioned between the No. 2 coil device and No. 3 coil device.

As can be seen from the above, the means for adjusting the distance comprises the mechanism for displacing the work coils 5 and 7 including the displacing motor 59, the displacing screw 61, the threaded plates 37 and 39, and the mechanism for shifting the work coils 5 and 7 including the center shifting motor 69, the shifting screw 71, the support plate 65, and the thread 67 provided through the support plate 65. The means for adjusting the power is the high frequency power source (not shown).

The work hanger designated generally by the reference numeral 77 is designed to be suitable for the shape or number of the work (W) to be hung. The work hanger 77 includes poles 79 made of electrically conductive material (e. g. copper) of square cross section disposed in constant interval. Each pole is provided with arm mounting bars 81, positioned therealong in constant interval. A pair of hooks designated by the reference numerals 83 and 84 is attached to both sides of each bar 81 respectively.

Pyramid shaped barbs 85 and 87 are formed at the tip of the hooks. The work (W) is adapted to be supported by the work hanger 77 by inserting the arms 83 and 88 into the holes 88 provided through the upper portion of the work.

The work hanger 77 can be transferred by means of the hanger transferring means as disclosed in the above mentioned patent documents 1 and 2.

Figure 8:
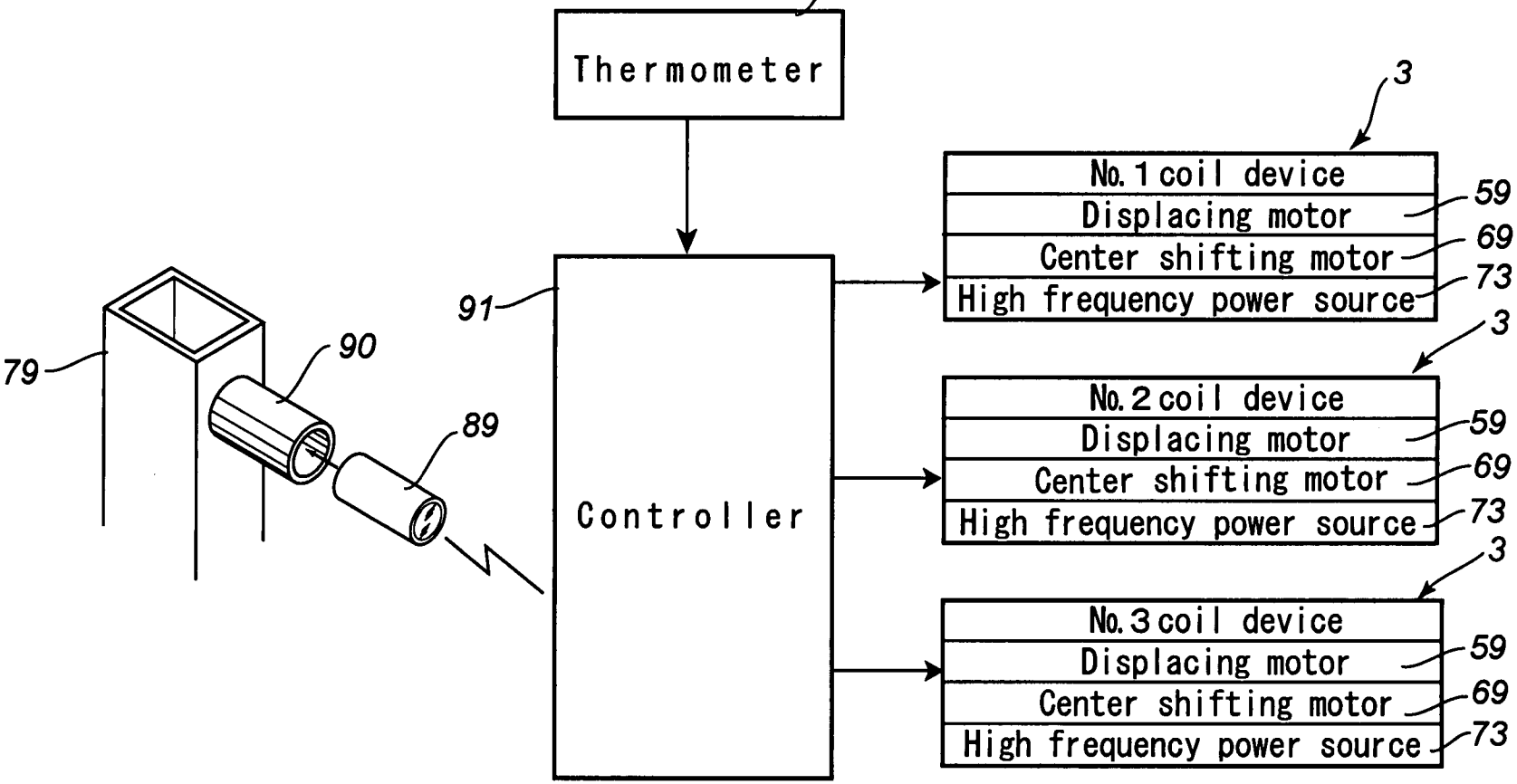
FIG. 8 is a diagram showing the control system of the heating apparatus of FIG. 1.
Figure 10:
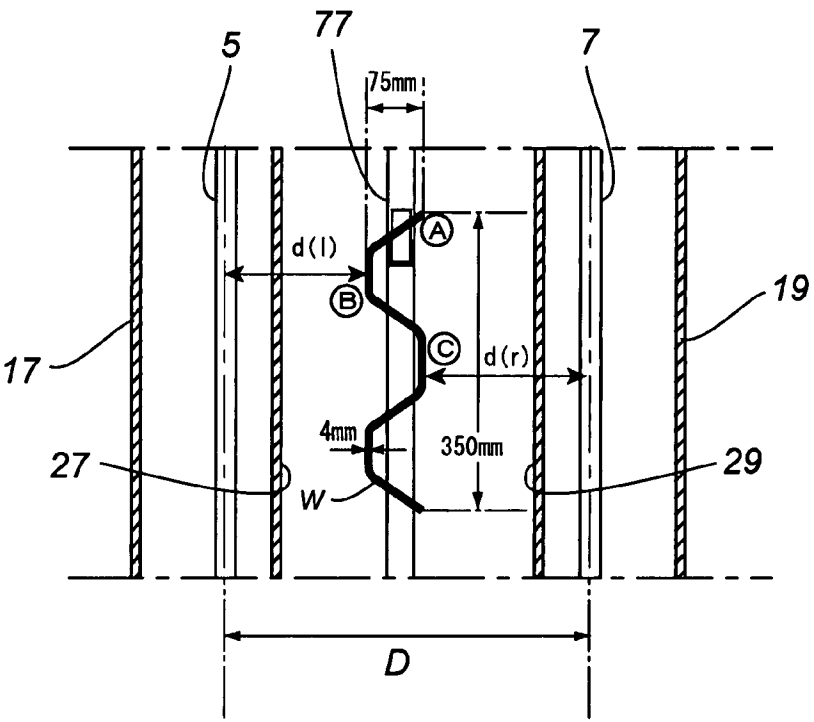
FIG. 10 is a view showing a part of FIG. 9.
Figure 9:
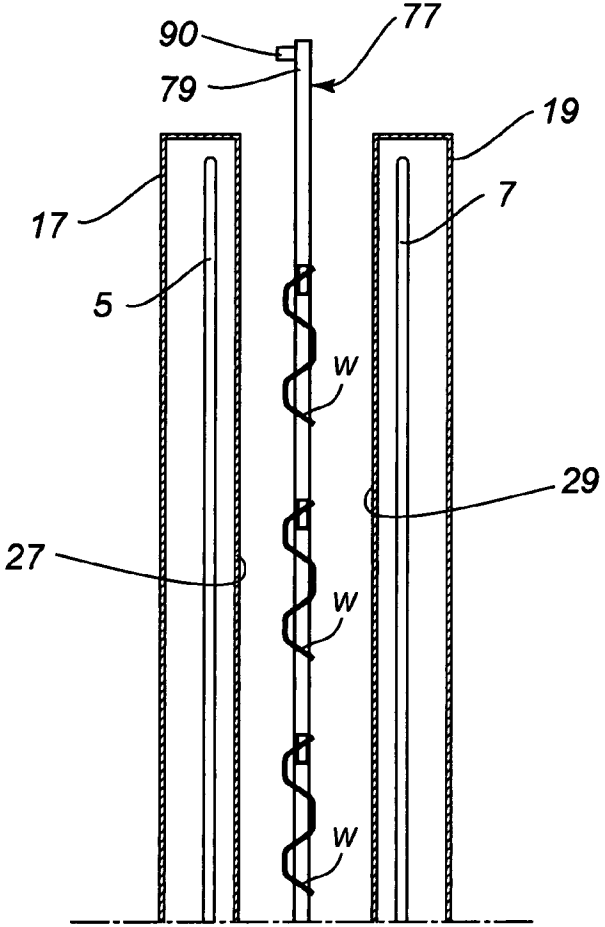
FIG. 9 is a diagram showing the method for heating the work by means of the heating apparatus of FIG. 1.
Figure 11:
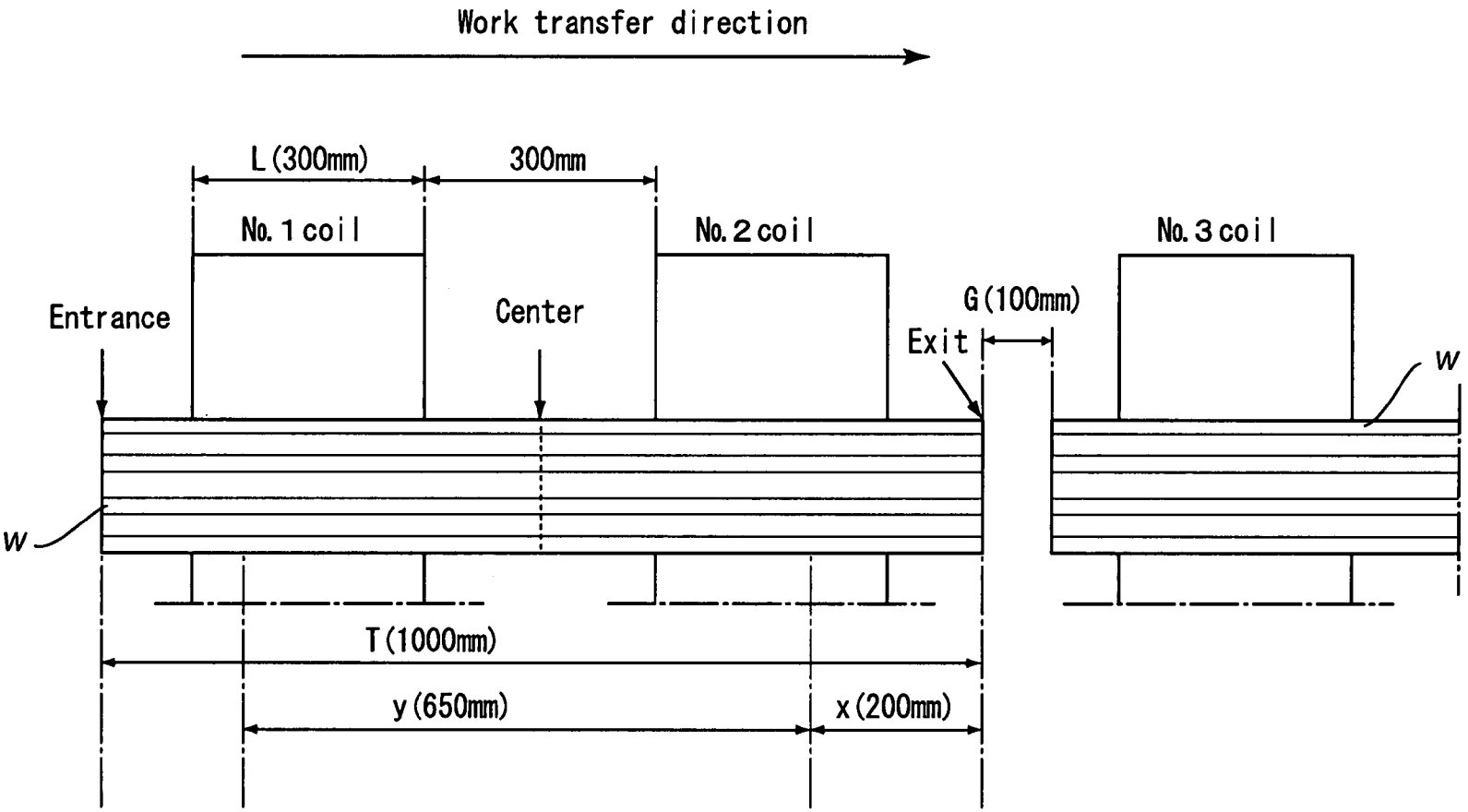
FIG. 11 is a plan view of FIG. 9.

The control system will now be described with reference to FIG. 8.

A reloadable recording media or tag 89 in which the serial number of the work (W) is stored is adapted to be fit into the socket 90 provided on the pole 79 of the hanger 77.

A controller designated by the reference numeral 91 is connected with the high frequency power sources for Nos. 1, 2, and 3 coil devices, the power source (not shown) for the displacing motor 59 and the center shifting motor 69, and the radiation thermometer.

The controller 91 also includes a reading portion for reading the data stored in the tag 89.

Upon read the serial number of the work (W) from the tag 89, the controller 91 picks up from the preliminary stored data file the information on the output of each power source 73 of each coil devices relative to the work (W) and on the information for the driving the motors 59 and 69, and makes control accordingly.

Further, the controller 91 tunes the high frequency output of the No. 3 coil device based on information obtained from the radiation thermometer.

The method for using the apparatus 1 for heating works (W) will now be described.

At first, before actually heating the works (W), a sample work of the same configuration as that of the real work is provided with a plurality of thermometer for example thermocouples, and then the experimental work is transferred into the heating apparatus 1 to examine the condition of the work being heated.

Subsequently, the distance between the work coils 5 and 7, the distance between the work (W) and the work coil 5, and the distance between the work (W) and the work coil 7, and the output to be delivered are set to be optimal in each of the No. 1, 2, and 3 coil devices on the basis of thus obtained experimental result.

The adjustment or tuning is effected under the following principals;

(1) The narrower the distance (D) between the coils 5 and 7 or the greater the high frequency output, the temperature of the work (W) is increased. In other words, the broader the distance (D) between the coils 5 and 7 or the lower the high frequency output, the temperature of the work (W) is decreased.

(2) Even in the case that the work (W) of complex shape such as the guardrail of folded configuration is to be heated, the temperature differences among portions on the work can be reduced by adjusting the distance (d(r)) between the work (W) and the work coil 5, and/or the distance (d(l)) between the work (W) and the coil 7.

Further, the temperature of the work (W) can be increased by reducing the rate of travel of the work passing through the space defined between the coils, and the temperature of the work (W) can be decreased by accelerating the work passing through the space between the coils.

Figure 7:
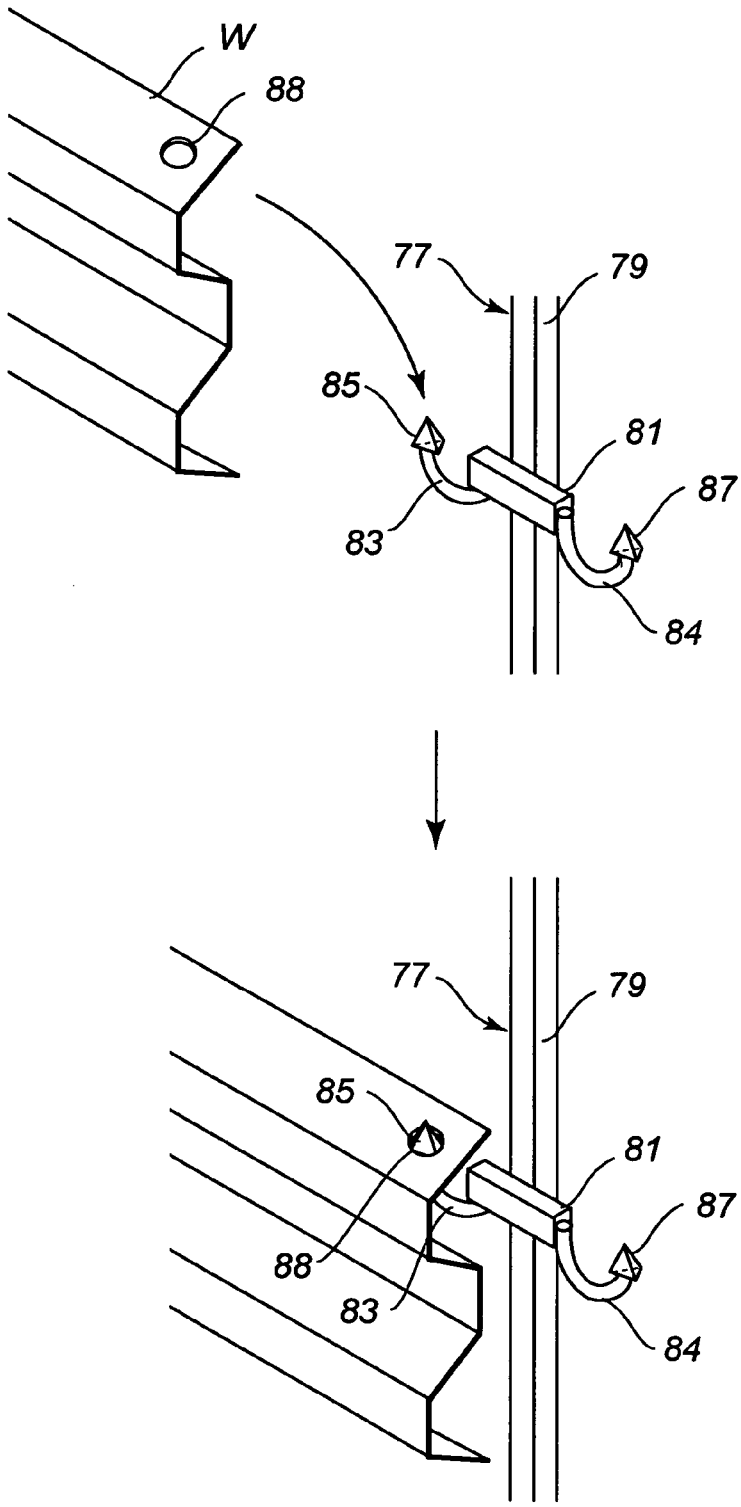
FIG. 7 is a perspective view showing the method for hanging the work on the work hanger shown in FIG. 1.

A guardrail blank of long sideways as shown in FIGS. 1 and 9–11 (uncoated, the thickness =4 mm, and the lateral length (T)=1000 mm) is used as the work (W) to be coated. A plurality of guardrail blanks is hung as shown in FIG. 7. The lateral distance (G) between the opposite edges of the adjacent blanks is defined to be 100 mm. The width (L) of each coil device is 300 mm, and the distance between the coil devices is defined to be 300 mm. The coil devices are arranged in series in the transferring direction. The thermocouples are connected to the work (W) at the positions designated in FIG. 10 by the reference numerals (A), (B), and (C). Thus, prepared work (W) is transferred in the spacing designated by the arrow illustrated in FIGS. 1 and 11 through the coil devices with varying the condition such as the distance (D) between the coils and/or the output of the high frequency energy. Then the heated condition (attained maximum temperature) of each portion on the work (W) is examined immediately after delivered through the high frequency induction-heating device 3.

The temperature attained when only one work is hung on the hanger 77 is different from that attained when a plurality of works are hung. In this connection, a plurality of works (W) is hung upon effecting the examination in order to follow the actual heating condition. The test results obtained on each work are listed in the following table.

TABLE 1

| Rate of travel = 0.8 m/min | No. 1 | No. 2 | No. 3 |
|---|---|---|---|
| D (mm) | 185 | 185 | 185 |
| d(r) (mm) | 55 | 55 | 55 |
| d(l) (mm) | 55 | 55 | 55 |
| High frequency output (kW) | 50 | 50 | 50 |

"d(r)" is the minimum distance between the work (W) and the work coil 7, and "d(l)" is the minimum distance between the work (W) and the work coil 5.

TABLE 2

| | Point of measurement | | |
|---|---|---|---|
| | Entrance | Center | Exit |
| | Position A | | |
| Temperature(° C.) | 165 | 218 | 183 |
| | Position B | | |
| Temperature(° C.) | 161 | 204 | 168 |
| | Position C | | |
| Temperature(° C.) | 168 | 216 | 182 |

The average temperature at the entrance is 165° C.

The average temperature at the center is 213° C.

The average temperature at the exit is 178° C.

The difference between the temperature at the entrance and that at the center is 48° C.

The difference between the temperature at the center and that at the exit is 35+ C.

As can be seen from the above, the temperature at the "entrance" is lower than that at the "center" by 48° C., and the temperature at the "exit" is lower than that at the "center" by 35° C. The temperature difference between the positions A and B is 4° C. at the entrance, 14° C. at the center, and 14° C. at the exit.

The following facts are confirmed under the obtained test results including the above:

(1) The temperature at the "entrance" is lower than that at the "center" by about 40–50° C., and the temperature at the "exit" is lower than that at the "center" by about 30–40° C., and (2) When the work (W) is of folded configuration such as the guardrail blank, the difference among the attained maximum temperatures of the portions A, B, and C is about 10–20° C. depending on the distance from the work coils 5 and 7.

When the temperature on the work (W) are scattered for each portion due to the uneven baking, the strength of the coating is reduced. The countermeasures to be taken for making the temperature of the work as uniform as possible are as follows;

(1) A plurality of induction-heating devices 3 are provided;

(2) At the entrance and the exit, the distance (D) between coils 5 and 7 is reduced and/or the output of the high frequency energy is enhanced to compensate for the lower temperature;

(3) The distance between the work coils 5 and 7 facing the guardrail blank and each portion of the work is adjusted.

The concrete countermeasures having been taken therefor under the following condition:

TABLE 3

| | No. 1 | | | No. 3 | |
|---|---|---|---|---|---|
| Travel distance | x | y | No. 2 | x | y |
| D (mm) | 175 | 185 | 185 | 175 | 185 |
| d(r) (mm) | 50 | 55 | 55 | 50 | 58 |
| d(l) (mm) | 50 | 55 | 55 | 50 | 52 |
| High frequency output (kW) | 30 | 30 | 24 | 30 | 30 |

The distance between coils is varied at the No. 1 and 3 devices. In other words, when the distance through which the blank is traveled, is 0–200 mm (x=200 mm), the coils 5 and 7 are under the condition defined in (x), when the traveled distance is 200–650 mm (y=650 mm), the coils are under the condition defined in (y), and after 650 mm travel, the coils are under the condition defined in (x). The displacement of the coils are effected by the motors 59 and 69.

The output of the No. 3 device can be adjusted precisely to optimize the finally achieved temperature based on the information on the temperature of the blank provided by the radiation thermometer 75.

Figure 12:
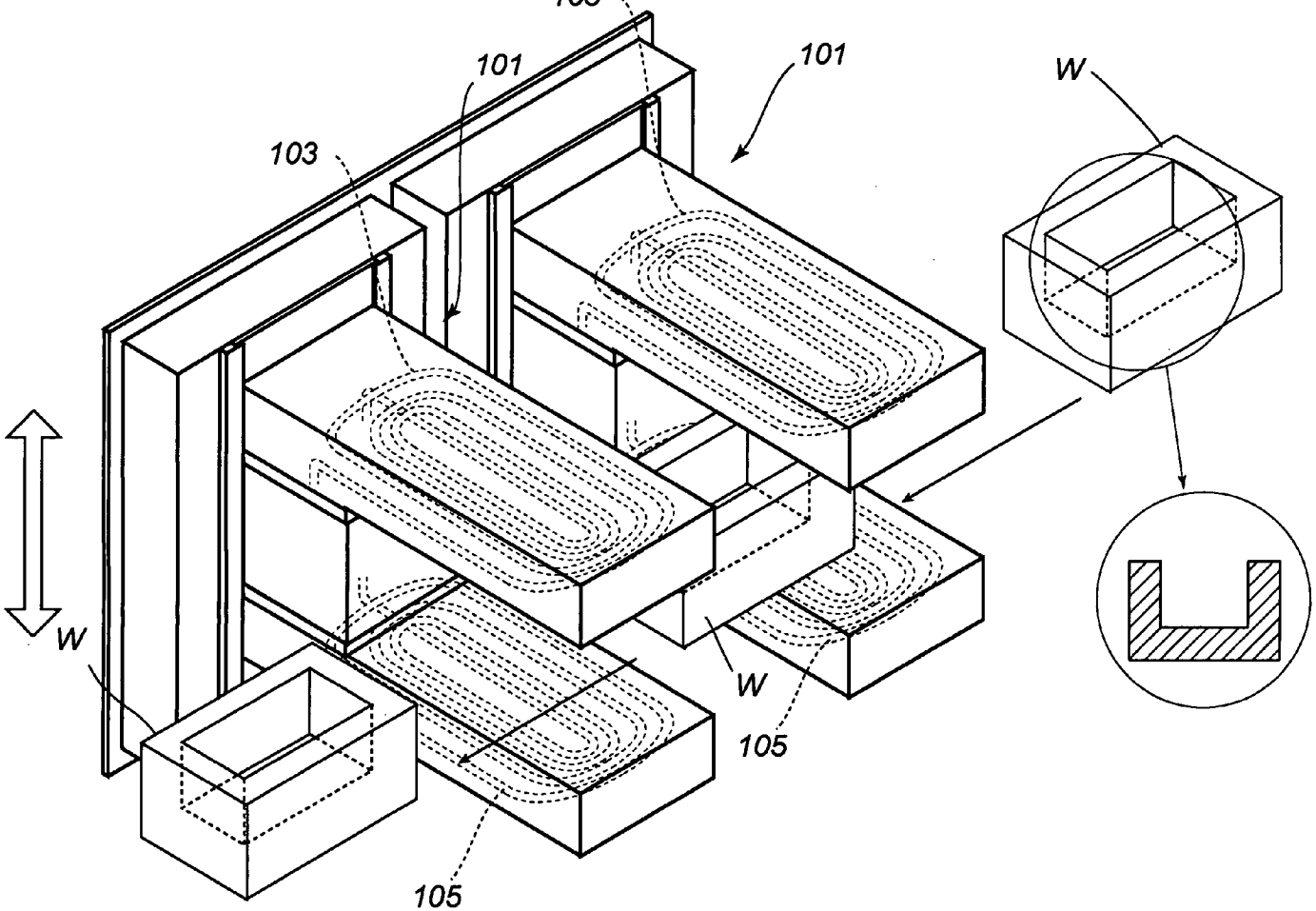
FIG. 12 is a perspective view showing the apparatus for heating work in accordance with a second embodiment of the invention.

The second embodiment of the present invention will now be described with reference to FIG. 12.

The unique feature of the high frequency induction-heating device designated generally by the reference numeral 101 is that a pair of work coils 103, 105 is disposed opposite to each other in the vertical direction. In other words, each coil extends horizontally. The work (W) to be heated is an upwardly opened box shaped blank having a cross section as illustrated within the circle. It is necessary to control the temperature of the work (W) accurately for heating the work (W) of such configuration uniformly. In this connection, it is desirable to place the work coils 103 and 105 vertically and to adjust the vertical distance from the work.

While particular embodiments of the present invention have been illustrated and described, it should be obvious to those skilled in the art that various changes and modifications can be made without departing from the spirit and scope of the invention.

For example, although the distance between the work coils and/or the output of the high frequency induction device or coil are in principle controlled on the basis of the preliminary stored information in the first embodiment, these can be controlled sequentially on the basis of the information of the temperature obtained from the thermometers provided at a plurality of portions.

Further, a thermometer can be provided at the exit of the apparatus to estimate the quality of the heated work based on the information on the temperature obtained therefrom.

When the apparatus and the method for heating works in accordance with the present invention are employed to baking the powder coated work or article, a dome shaped drying facility is not required since the work is not heated from outside as well as the degreasing operation can also be eliminated.

Further, even if much thinner coating is desirably formed as is obtained through the electrostatic coating process, the work of better quality can be provided.

What is claimed is:

1. An apparatus for heating a work, comprising:

a plurality of high frequency induction-heating devices, each device including:

an independent pair of opposite work coils which the work passes between, an independent distance adjuster for individually and independently adjusting the distance between the work and one work coil and between the work and the other work coil without movement of the work coil in the direction of passage, and an independent output adjuster for adjusting high frequency output of the work coils, wherein the plural devices are arranged along the passage of the work from upstream to downstream, respectively, the adjacent upstream-side device and downstream-side device can be independently operated to each other, and the individual distance adjusters and output adjusters can be operated during heating to facilitate uniform heating in the direction of passage of a work.

2. The apparatus for heating a work according to claim 1, wherein the distance adjuster includes a displacing means for displacing the work coils to change the distance between the work coils, and a shifting means for shifting the center of the spacing defined the work coils.

3. The apparatus for heating a work according to claim 1, further comprising a controller for controlling the distance adjuster and the output adjuster independently per each device, wherein the controller has obtained the distance information from the work to each coil and/or the output information for ensuring uniform heating in the direction of passage of a work of a given shape, and when the work is passing, the controller controls the distance adjuster and/or the output adjuster to adjust the distance and/or the output per device based on a portion, with respect to the device, of the work passing.

4. The apparatus for heating a work according to claim 1, further comprising a thermometer for measuring a work temperature, disposed between the adjacent devices, based on which information, the distance and/or output of the downstream-side of one of the adjacent devices will be adjusted by the controller.

5. A method for heating a work by means of the heating apparatus according to claim 1, comprising the steps of:

preparing a work, of a limited length in the direction of passage to be heated, and passing the work continuously through the pair of work coils of the high frequency induction-heating devices.

6. The method for heating a work according to claim 5, further comprising the steps of:

examining with a sample work of a given shape how a plurality of portions of the work is heated, obtaining, based on the examination, the distance information from the work to each coil and/or the output information for ensuring uniform heating in the direction of passage of the work, and passing the work while controlling the distance and/or output per device based on the portion of the work, with respect to the device, being passed.

7. The method for heating a work according to claim 5, further comprising the steps of:

disposing a thermometer for measuring a work temperature between the adjacent devices, and adjusting the distance and/or the high frequency output based on temperature information from the thermometer.

8. The method for heating a work according to claim 7, wherein a plurality of works are passed continuously through the pair of work coils.

9. The method for heating a work accordingly to claim 5, wherein the work to be heated has been powder coated and the heating is conducted for baking as a post-coat treatment.

10. The method for heating a work according to claim 9, wherein the work has been powder coated through electrostatic coating process.

* * * * *